US009176475B2

(12) United States Patent
Courvoisier

(10) Patent No.: US 9,176,475 B2
(45) Date of Patent: Nov. 3, 2015

(54) TIMEPIECE BALANCE SPRING STUD-HOLDER WITH NO SCREWS

(71) Applicant: ETA SA Manufacture Horlogere Suisse, Grenchen (CH)

(72) Inventor: Raphael Courvoisier, Corcelles (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/519,293

(22) Filed: Oct. 21, 2014

(65) Prior Publication Data

US 2015/0138934 A1 May 21, 2015

(30) Foreign Application Priority Data

Nov. 20, 2013 (EP) ..... 13193609

(51) Int. Cl.
*G04B 17/32* (2006.01)
*G04B 18/06* (2006.01)

(52) U.S. Cl.
CPC ..... *G04B 18/06* (2013.01); *G04B 17/325* (2013.01)

(58) Field of Classification Search
CPC ..... G04B 17/04; G04B 17/06; G04B 17/32; G04B 13/325; G04B 18/06
USPC ..... 368/175, 176, 178
See application file for complete search history.

(56) References Cited

U.S. PATENT DOCUMENTS

| | | | | | |
|---|---|---|---|---|---|
| 221,180 | A | * | 11/1879 | Monday | 368/178 |
| 440,877 | A | * | 11/1890 | Higgingbotham | 368/178 |
| 1,181,510 | A | * | 5/1916 | Eberhard | 368/176 |
| 3,046,725 | A | * | 7/1962 | Vuilleumier | 368/178 |
| 3,872,663 | A | * | 3/1975 | Meitinger | 368/178 |
| 5,907,524 | A | * | 5/1999 | Marmy et al. | 368/175 |
| 7,237,945 | B2 | * | 7/2007 | Geyer | 368/178 |
| 2011/0051565 | A1 | | 3/2011 | Schmiedchen | |

FOREIGN PATENT DOCUMENTS

| | | |
|---|---|---|
| CH | 332 548 | 9/1958 |
| CH | 609 515 | 3/1979 |
| EP | 2 290 477 A1 | 3/2011 |

OTHER PUBLICATIONS

European Search Report issued Jun. 11, 2014 in European Application 13193609, filed on Nov. 20, 2013 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

An assembly for holding or supporting a timepiece balance spring includes a balance spring stud and a stud-holder. The stud-holder includes a device to secure the stud-holder to an escapement mechanism. The balance spring stud includes a lateral bearing surface defining a direction of holding or supporting the balance spring. The stud-holder is in two parts, and includes a rigid structure carrying the securing device, and a strip spring pressed against this rigid structure and including at least one elastic lip defining, with this structure, a chamber for receiving this stud and cooperating with this lateral bearing surface of this stud to hold this stud in an indexed locking position.

20 Claims, 3 Drawing Sheets

TIMEPIECE BALANCE SPRING STUD-HOLDER WITH NO SCREWS

This application claims the priority from European Patent application No. 13193609.8 filed on Nov. 20, 2013, the entire disclosure of which is hereby incorporated herein by reference.

FIELD OF THE INVENTION

The invention concerns an assembly for holding or supporting a timepiece balance spring, including a balance spring stud and a stud-holder, said stud-holder includes means of securing said stud-holder to an escapement mechanism, and said balance spring stud includes at least one orientation surface defining a direction of holding or supporting a said balance spring.

The invention also concerns a timepiece escapement mechanism including at least one holding assembly of this type.

The invention also concerns a timepiece movement including at least one such escape mechanism.

The invention also concerns a timepiece comprising at least one movement of this type.

The invention concerns the field of timepiece escapement mechanisms.

BACKGROUND OF THE INVENTION

In numerous mass-produced calibres, the balance spring stud, forming the external point of attachment of the balance spring, is clipped to a stud-holder, which is a flat, stamped part.

In high end productions, the balance spring stud is screwed into a stud-holder which is a machined component. The retaining screw then works between the screw foot and threads. The head is never locked, which causes frequent breakage, as a result of the torsion stresses experienced when the foot is locked onto the balance spring stud and when the operator continues to turn the screw.

CH Patent Application No 332548A in the name of PARECHOC SA discloses a device for regulating the active length of a balance spring, wherein the end of the balance spring is secured without a stud, by a device which clamps the balance spring directly, without the intermediary of a balance spring stud. A component called a "balance spring holder" and a component called a "bent plate" are necessary to confine, together, the balance spring. This bent plate, which is an independent component, cannot be equated with a balance spring stud. A screw is used to lock the balance spring. A first elastic strip is used to determine the active length of the balance spring. The bent plate pushes a second elastic strip onto said first elastic strip to prevent it from moving in an inopportune manner. This mechanism does not allow for the insertion and release of a unit carrying the balance spring, simply by the elastic effect of a strip.

EP Patent Application No 2290477A1 in the name of GLASHÜTTE UHRENBETRIEB describes a stud-holder which includes an inner thread for securing the stud retaining screw, which cooperates with a recess in said stud, over one part of the thickness of the stud. The dividing wall which carries the internal thread receiving the screw is a rigid wall. This construction uses a anti-friction pad able to be added between the stud and the balance spring in order to modify the point of attachment. Therefore, this is again a system for adjusting the active length of the balance spring.

In both cases, it is the actual balance spring which is clamped. This cannot work with a silicon balance spring which cannot withstand torsion or compression stresses.

SUMMARY OF THE INVENTION

The invention proposes to provide a solution for holding the outer coil of the balance spring, which is compatible with high end movements, and to solve the recurrent problem of retaining screws via a securing solution which is free of screws.

To this end, the invention concerns an assembly for holding or supporting a timepiece balance spring, including a balance spring stud and a stud-holder, said stud-holder includes means of securing said stud-holder to an escapement mechanism, said balance spring stud including at least one orientation surface defining a direction of holding or supporting a said balance spring, characterized in that said stud-holder is in two parts, and includes a rigid structure carrying said securing means, and a strip spring pressed against said rigid structure and including at least one elastic lip defining, with said structure, a chamber for receiving said stud and cooperating with said at least one orientation surface of said stud for holding said stud in an indexed locking position.

According to a feature of the invention, said lateral bearing surface forms an orientation surface which defines a single direction of the outer end of said balance spring.

The invention also concerns a timepiece escapement mechanism including at least one holding assembly of this type.

The invention also concerns a timepiece movement including at least one such escape mechanism.

The invention also concerns a timepiece including at least one movement of this type, characterized in that said timepiece is a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

To eliminate the use of screws to hold the stud, the invention uses a fixing element including elastic return means, on the one hand to allow the introduction or extraction of a stud by exerting a certain force on said stud, and on the other hand, to hold said stud in an operating position in a single stop position.

Figure 1:
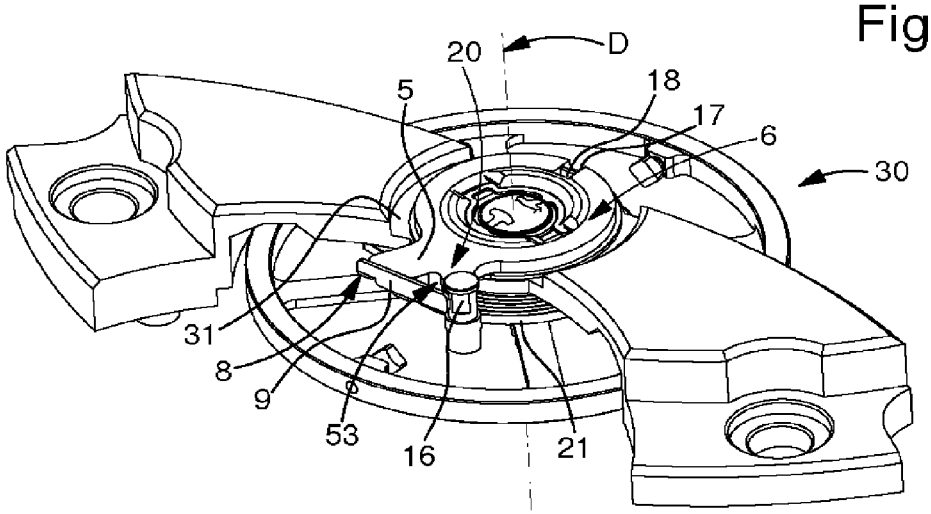
FIG. 1 shows a schematic, partial, perspective view of an escapement mechanism including a balance spring holding assembly according to the invention, in a position displaying the balance spring stud, holding the outer coil of the balance spring, at a section of insertion of the stud into a chamber comprised in said holding assembly, which is fixed to a structure of the escapement mechanism such as a balance cock.

The invention thus concerns an assembly 20 for holding or supporting a timepiece balance spring 21 including a balance spring stud 1 and a stud-holder 2. This stud-holder 2 includes means 6 of securing stud-holder 2 to an escapement mechanism 30 such as a balance cock, as seen in FIG. 1.

Balance spring stud 1 includes at least one lateral bearing surface 7 defining a direction of holding or supporting a balance spring 21 of this type.

According to the invention, this stud-holder 2 is in at least two parts, and includes a rigid structure 5 carrying securing means 6 and a strip spring 8 pressed against this rigid structure 5. This strip spring 8 includes at least one elastic lip 9 defining with rigid structure 5 a chamber 10 for receiving balance spring stud 1. This elastic lip 9 cooperates with said at least one lateral bearing surface 7 of stud 1 to hold stud 1 in an indexed locking position. In short, stud 1 is clamped between elastic lip 9 of strip spring 8 and a notch 53 of rigid structure 5 seen in FIG. 2.

Preferably, the lateral bearing surface 7 forms an orientation surface which defines a single direction of the outer end of balance spring 21.

The invention is illustrated in a preferred embodiment wherein stud-holder 2 is in two parts, which is economical since each of the two components comprised therein is very simple to create, and perfectly compatible with mass production sizes. This stud-holder 2 in two parts also requires a minimum amount of space. Indeed, preferably, and as seen in the Figures, strip spring 8 at least partially envelopes rigid structure 5 and the total space occupied, in the direction D of the balance pivot axis, is the sum of the total thickness of rigid structure 5 and the thickness of a metal sheet in which strip spring 8 is preferably formed.

Thus, advantageously, stud-holder 2 is formed of two complementary parts, each arranged to cooperate with one surface of stud 1 to hold the latter clamped.

Figure 2:
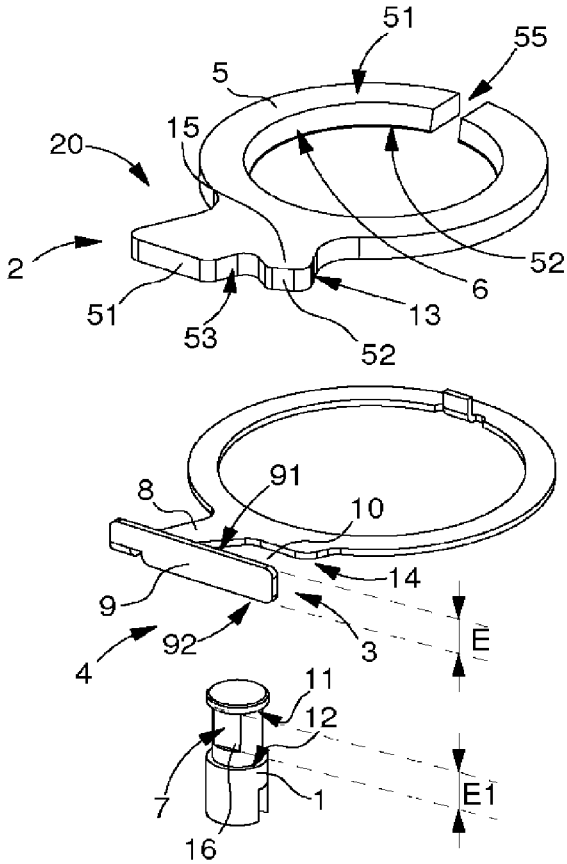
FIG. 2 shows a schematic exploded perspective view of this holding assembly, said holding assembly including a rigid structure in a first variant having a constant thickness, and a strip spring, arranged to form together a chamber for receiving and clamping the balance spring stud, and the stud arranged to cooperate with said assembly.
Figure 3:
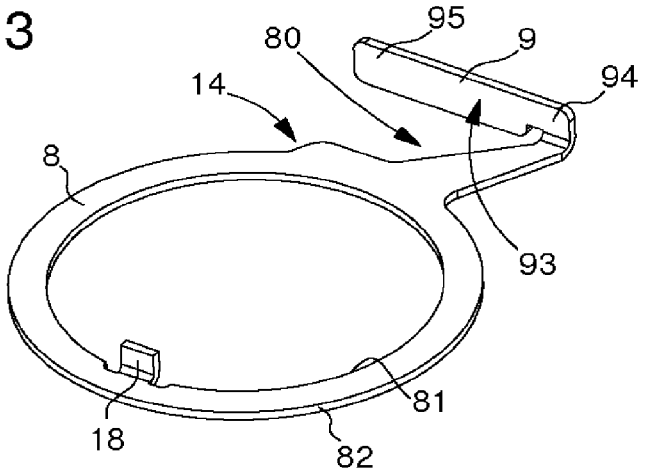
FIG. 3 shows a schematic, perspective view of the strip spring of FIG. 2.

The strip spring 8 illustrated in FIGS. 1, 2 and 3, is preferably made of cut, folded sheet metal and requires no other particular machining. The strip spring is inexpensive, which makes it possible to use, with the same supporting structure 31 of escapement mechanism 30, and with the same rigid structure 5, several strip springs 8 of different sizes to cooperate with as many stud models having different geometries.

Figure 4:
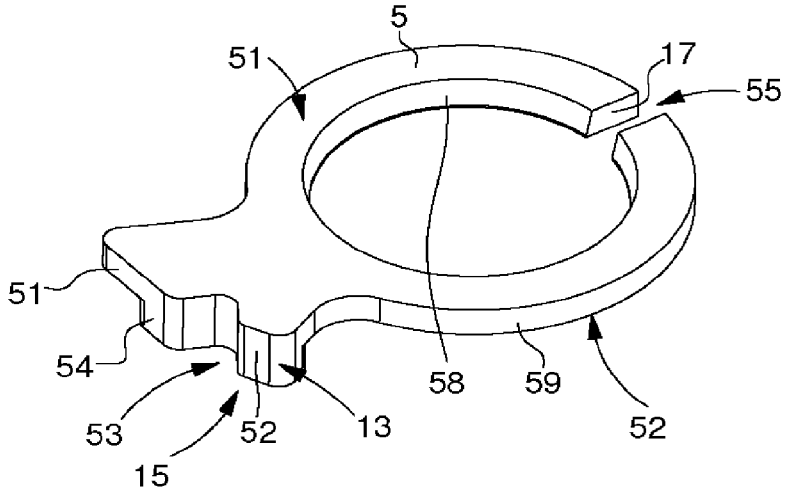
FIG. 4 shows a schematic, perspective view of a rigid structure in a second variant on two levels.
Figure 5:
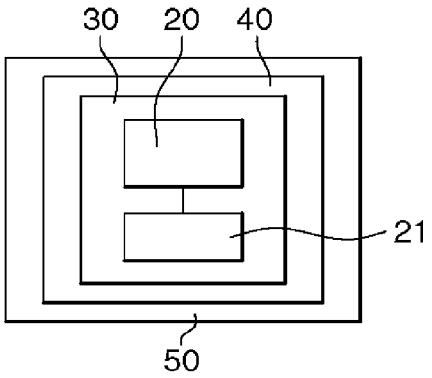
FIG. 5 is a block diagram of a timepiece comprising a movement which includes an escapement mechanism including a balance spring held by an assembly according to the invention.

Rigid structure 5 may, depending on its size, be machined, or also created by stamping in a thicker and more rigid material than strip spring 8. FIG. 2 shows a first, very economical variant having a constant thickness, which is suited to a stamped embodiment of this type. FIG. 4 shows a second variant of rigid structure 5 on two levels, which is preferably machined.

The assembling of holding assembly 20 according to the invention simplifies the machining and creation of the stud-holder, since, unlike the prior art, it is no longer necessary to make a bore or similar recess for receiving balance spring stud 1, or an internal thread for cooperating with a locking screw.

The non-limiting variant embodiments illustrated in the Figures, allow for great ease of assembly, combined with low production costs.

Preferably, stud 1 includes, on either side of the at least one lateral bearing surface 7 comprised therein for defining the orientation of the outer end of balance spring 21, stop surfaces 11, 12 for limiting the travel of stud 1 in direction D of the axis of balance spring 21 relative to the clamp formed by the assembly of rigid structure 5 and strip spring 8. In the variant illustrated, elastic lip 9 of strip spring 8 has two edge surfaces 91 and 92 which are parallel (and each located in a perpendicular plane to direction D) and cooperates with this lateral bearing surface 7, which is formed here by a flat portion 16 delimited by stop surfaces 11 and 12. Preferably, in the different variants shown, lateral bearing surface 7 is a flat portion 16 parallel to axis D of balance spring 21.

In a foolproof version, the space E1 between stop surfaces 11 and 12 can be defined equal to the space E between edge surfaces 91 and 92 for holding with no axial play. Thus, in this foolproof version, this at least one lateral bearing surface 7 is adjusted to stop surfaces 11, 12 to define only one position of balance spring stud 1 in the direction of axis D of balance spring 21.

In another variant, a certain clearance may be left allowing for limited axial adjustment of stud 1, by selecting space E1 greater than space E, by the value of the desired adjustment range.

In yet another variant, stud 1 has no stop surface, on at least one side in direction D.

To facilitate the introduction or extraction of stud 1 relative to this holding assembly 20, rigid structure 5 and/or strip spring 8 includes an insertion ramp 13, 14 for the tangential insertion (along the arrow of FIG. 1), or conversely the tangential extraction of stud 1 between rigid structure 5 and strip spring 8. This simple or compound ramp facilitates insertion into chamber 10 against the elastic return force of strip spring 8. The same is true for extraction. When stud 1 is pressed against this ramp and strip spring 8, it is easy to raise elastic lip 9 to enable the stud to reach its mounted position inside chamber 10 delimited by a notch 15 forming an insertion or extraction threshold.

In the illustrated variants, chamber 10 is situated, on the side of strip spring 8, in a recess 80 seen in FIG. 3, stud 1 bearing on a rear face 93 of elastic lip 9 and, on the side of rigid structure 5, in a notch 53. This notch 53 is delimited on the one hand by a preferably curved entry sector 52, forming a ramp 13 of this type, and on the other hand by a flat portion 51. This flat portion 51 may, depending on the embodiment chosen, either remain remote from elastic lip 9 or, as illustrated in FIG. 3, receive in abutment one portion 94 of elastic lip 9, with only one overhanging end 95 cooperating in abutment with stud 1. Other variants may be imagined without departing from the invention, which consists in clamping the stud between a rigid structure and an elastic strip spring.

Chamber 10 is devised, in all the variants, to immobilise stud 1 in only one position in projection into a plane perpendicular to axis D.

Preferably, rigid structure 5 and/or strip spring 8 includes a notch 15 in chamber 10 corresponding to the insertion or extraction threshold.

For optimum relative positioning between rigid structure 5 and strip spring 8 in an advantageous embodiment illustrated in the Figures, rigid structure 5 includes a notch 17 (or a slot or suchlike) or a lug arranged to cooperate with a lug 18, or respectively a notch, comprised in strip spring 8 to secure in rotation rigid structure 5 and strip spring 8, pressed on top of the other. In a non-illustrated variant, the strip spring may also include at least three tabs folded at 90° like elastic strip 9, and located on a bore 81 or a peripheral edge 82 of strip spring 8, arranged to cooperate with a bore 58 or a peripheral edge 59 of rigid structure 5 to ensure the perfectly coaxial assembly of the two elements.

This relative positioning makes it possible to synchronise rigid structure 5 and strip spring 8, either during the assembling thereof, or in an adjustment phase if it is decided to grant holding assembly 20 a limited angular mobility to perform an angular adjustment of the position of stud 1. Naturally, the mechanism then requires at least means for holding assembly 20 in position relative to structure 31.

Preferably, rigid structure 5 is of substantially annular shape enabling it to be held bearing on a structure 31, particularly a balance cock, of escapement mechanism 30 about axis D of balance spring 21.

Preferably, strip spring 8 is of substantially annular shape enabling it to be held bearing between a structure 31 and rigid structure 5, or bearing on rigid structure 5 over their entire shared periphery, about axis D of balance spring 21. Advantageously, the rigid structure is mounted on structure 31 so as to confine strip spring 8.

In an economical embodiment, rigid structure 5 includes at least one face 51, 52 perpendicular to axis D of said balance spring 21, and preferably rigid structure 5 includes two faces 51, 52 which are parallel to each other and perpendicular to axis D of balance spring 21.

The particular case of rigid structure 5 on two levels in FIG. 4 allows for compatibility with an escapement mechanism originally provided with a conventional stud-holder having screws, the higher production cost thereof is compensated for by the advantage of improved guiding of stud 1, over a larger height.

Figure 6:
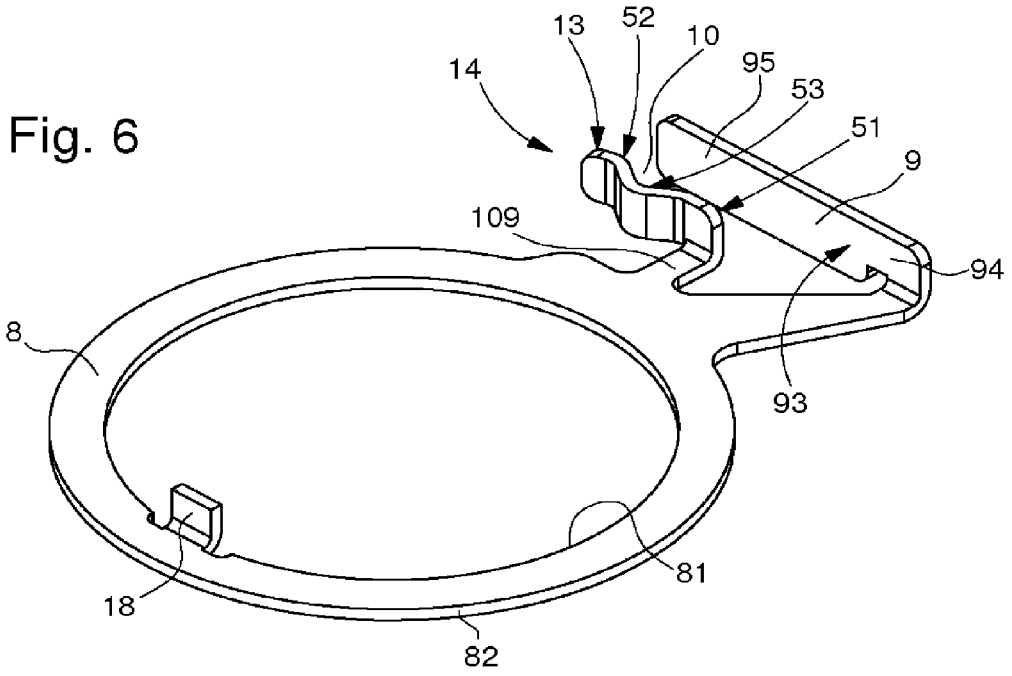
FIGS. 6 and 7 show a schematic, perspective view of two variants wherein the chamber for receiving the stud is delimited by two flexible strips comprised in the strip spring.
Figure 7:
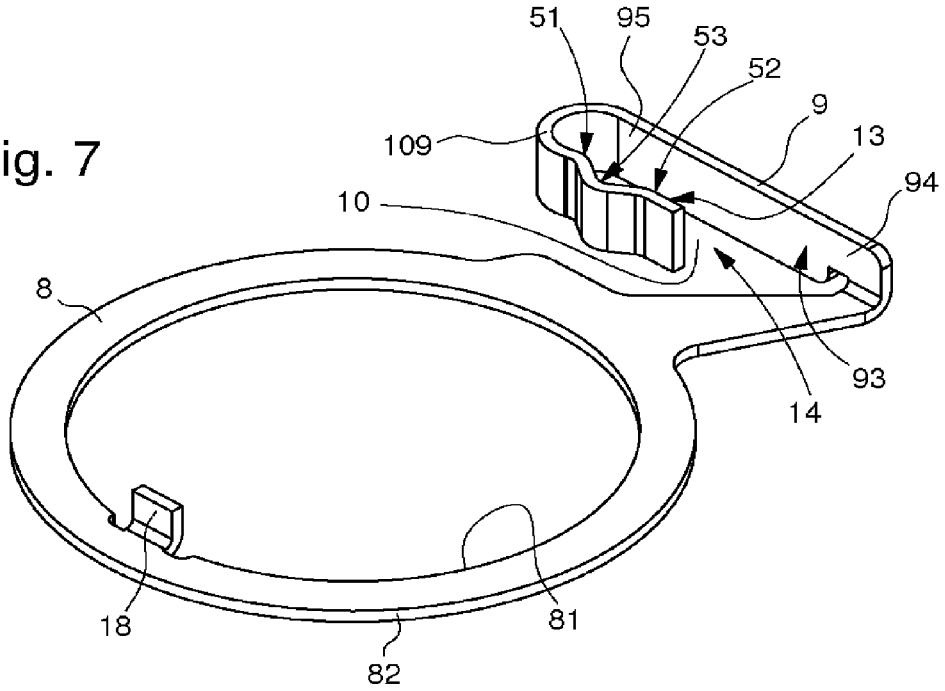

FIGS. 6 and 7 illustrate two variants with a single-piece folding part, which includes, in addition to elastic strip 9, an additional, preferably elastic wing 109, comprised in a notch 53 delimited, on the one hand, by a preferably curved entry sector 52, forming a ramp 13, and on the other hand, by a flat portion 51. It is preferable to provide a holding element for the shock absorber in these two variants. Chamber 10 is thus delimited here by these two flexible strips 9 and 109. Rigid structure 5 can then be reduced to a simple washer provided with means 6 of securing to the balance cock.

Another variant consists in making the stud-holder entirely in one-piece, also incorporating the means of securing to the balance cock, but this seems more expensive to manufacture, since it preferably includes areas with different sections of material.

The invention also concerns a timepiece escapement mechanism 30 including at least one such holding assembly 20.

The invention also concerns a timepiece movement 40 including at least one escapement mechanism 30 of this type.

The invention also concerns a timepiece 50 including at least one such movement 40. More particularly, this timepiece 50 is a watch.

In short, the invention provides various advantages:

- the attachment of the balance spring to the stud-holder is perfectly ensured;
- the invention allows the use of a balance spring made of silicon, quartz, amorphous material, DLC or suchlike;
- the screw of a conventional stud-holder having screws is replaced by an inexpensive cut out component;
- the machining of the rigid structure forming the stud-holder is greatly simplified, or replaced by stamping;
- the attractiveness and quality of the mechanism are compatible with high end timepiece movements;
- axial adjustment of the stud remains possible;
- the mechanism according to the invention is interchangeable, in an existing movement, with a conventional stud-holder.

What is claimed is:

1. An assembly for holding or supporting a timepiece balance spring, comprising:

a balance spring stud and a stud-holder, said balance spring stud being a separate part from the stud-holder, said stud-holder includes means of securing said stud-holder to an escapement mechanism, said balance spring stud including at least one lateral bearing surface defining a direction of holding or supporting a said balance spring, wherein said stud-holder is only two separate parts, and includes a rigid structure carrying said securing means, and a strip spring pressed against said rigid structure and including at least one elastic lip defining, with said structure, a chamber for receiving said stud and cooperating with said at least one lateral bearing surface of said stud to hold said stud in an indexed locking position.

2. The assembly according to claim 1, wherein said lateral bearing surface forms an orientation surface which defines only one direction of the outer end of said balance spring.

3. The assembly according to claim 1, wherein said balance spring stud includes, on either side of said at least one lateral bearing surface, stop surfaces for limiting the travel of said balance spring stud in the direction of the axis of said balance spring.

4. The assembly according to claim 1, wherein said at least one lateral bearing surface is adjusted to said stop surfaces to define only one position of said balance spring stud in the direction of the axis of said balance spring.

5. The assembly according to claim 1, wherein said rigid structure and/or said strip spring includes an insertion ramp for the tangential insertion of said balance spring stud between said rigid structure and said strip spring and the insertion thereof into said chamber against the elastic return force of said strip spring.

6. The assembly according to claim 1, wherein said rigid structure and/or said strip spring includes a notch in said chamber.

7. The assembly according to claim 1, wherein said lateral bearing surface is a flat portion parallel to the axis of said balance spring.

8. The assembly according to claim 1, wherein said rigid structure includes a notch or a lug arranged to cooperate with a lug or respectively a notch comprised in said strip spring, to secure in rotation said rigid structure and said strip spring pressed one on top of the other.

9. The assembly according to claim 1, wherein said rigid structure is of substantially annular shape enabling said structure to be held bearing on a structure of said escapement mechanism about the axis of said balance spring.

10. The assembly according to claim 1, wherein said strip spring is of substantially annular shape enabling said strip spring to be held bearing between a structure of said escapement mechanism and said rigid structure, or bearing on said rigid structure over the entire common periphery thereof about the axis of said balance spring.

11. The assembly according to claim 1, wherein said rigid structure includes at least one face perpendicular to the axis of said balance spring.

12. The assembly according to claim 1, wherein said rigid structure includes two faces which are parallel to each other and perpendicular to the axis of said balance spring.

13. The assembly according to claim 1, wherein the two parts of the stud-holder are each arranged to cooperate with one surface of the balance spring stud, to hold said stud clamped.

14. The assembly according to claim 1, wherein said strip spring further includes an additional wing cooperating with said elastic lip to define therewith said chamber for receiving said stud, and cooperating with said at least one lateral bearing surface of said stud to hold said stud in an indexed locking position.

15. The assembly according to claim 14, wherein said additional wing is elastic.

16. A timepiece escapement mechanism including at least one assembly according to claim 1.

17. A timepiece movement including at least one escapement mechanism according to claim 16.

18. A timepiece including at least one movement according to claim 17, wherein the timepiece is a watch.

19. The assembly according to claim 1, wherein the assembly holds or supports the timepiece balance spring without using a screw.

20. An assembly for holding or supporting a timepiece balance spring, comprising:

a balance spring stud and a stud-holder, said stud-holder includes means of securing said stud-holder to an escapement mechanism, said balance spring stud including at least one lateral bearing surface defining a direction of holding or supporting a said balance spring, wherein said stud-holder is in two parts, and includes a rigid structure carrying said securing means, and a strip spring pressed against said rigid structure and including at least one elastic lip defining, with said structure, a chamber for receiving said stud and cooperating with said at least one lateral bearing surface of said stud to hold said stud in an indexed locking position, and wherein said rigid structure and/or said strip spring includes an insertion ramp for the tangential insertion of said balance spring stud between said rigid structure and said strip spring and the insertion thereof into said chamber against the elastic return force of said strip spring.

* * * * *